United States Patent [19]

Iqbal et al.

[11] 4,206,705

[45] Jun. 10, 1980

[54] ELECTRIC INITIATOR CONTAINING POLYMERIC SULFUR NITRIDE

[75] Inventors: Zafar Iqbal; Harry D. Fair, Jr., both of Morristown, N.J.; David S. Downs, Flanders, all of N.J.

[73] Assignee: The United States of America as represented by the Secretary of the Army, Washington, D.C.

[21] Appl. No.: 916,680

[22] Filed: Jun. 19, 1978

[51] Int. Cl.[2] ..... F42D 1/04; F42C 19/12; F42B 3/12

[52] U.S. Cl. ..... 102/23; 102/28 R; 102/28 EB; 102/203; 149/120

[58] Field of Search ..... 102/203, 28 M, 28 R, 102/28 EB, 23; 423/406; 149/120

[56] References Cited

U.S. PATENT DOCUMENTS

| | | | |
|---|---|---|---|
| 3,344,744 | 10/1967 | Bankston, Jr. | 102/28 EB |
| 3,732,129 | 5/1973 | Martin | 102/28 EB |
| 3,756,154 | 9/1973 | Snyder | 102/28 R |
| 3,965,951 | 6/1976 | Scott et al. | 102/28 R |

OTHER PUBLICATIONS

Bright et al., *Applied Physics Letters,* 26 (#11), 612–615, (1975).

Mikulski, et al., *J. Am. Chem. Soc.,* 97 (#22), 6358–6363, (1975).

*Primary Examiner*—Edward A. Miller

*Attorney, Agent, or Firm*—Nathan Edelberg; Robert P. Gibson; A. Victor Erkkila

[57] ABSTRACT

Polymeric sulfur nitride $(SN)_x$ is utilized as the conducting explosive material in electric initiators.

2 Claims, 1 Drawing Figure

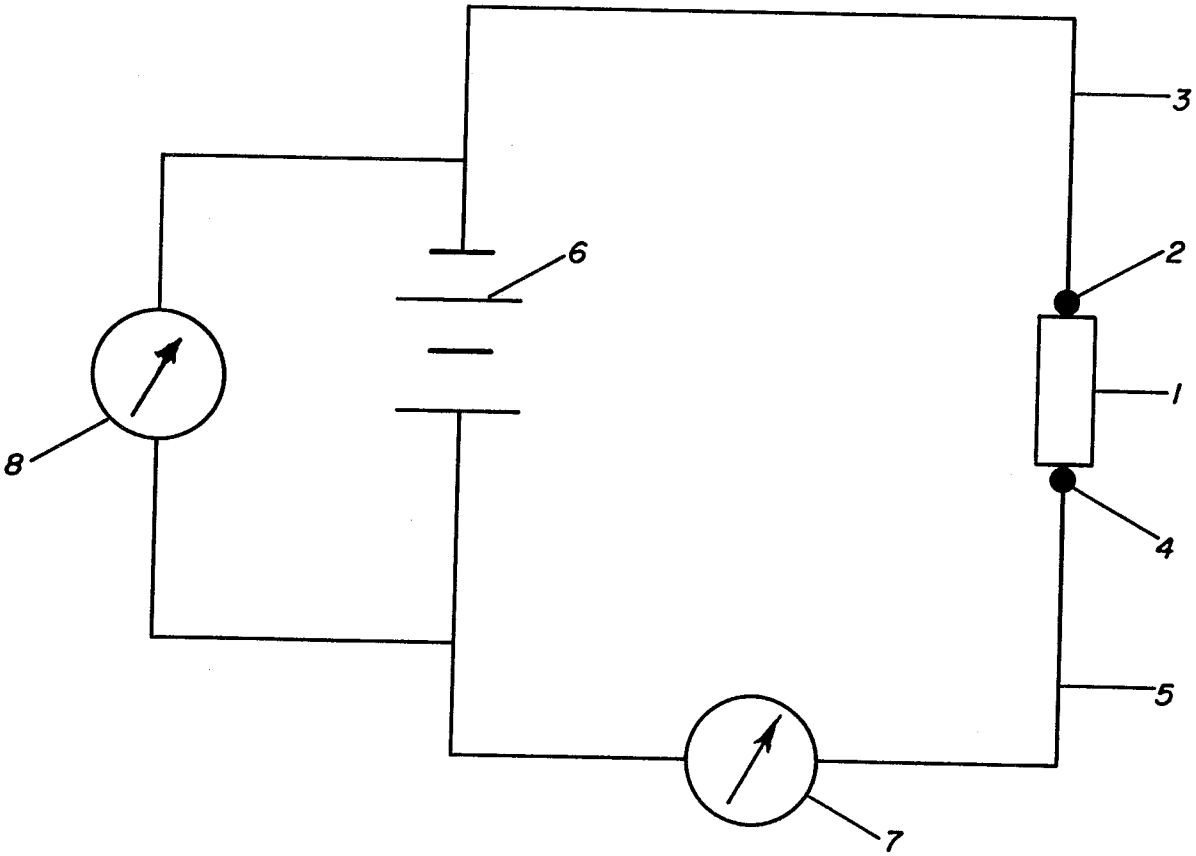
3
2
1
4
5
7
6
8

ELECTRIC INITIATOR CONTAINING POLYMERIC SULFUR NITRIDE

GOVERNMENTAL INTEREST

The invention described herein may be manufactured, used and licensed by or for the Government for governmental purposes without the payment to us of any royalty thereon.

BACKGROUND OF THE INVENTION

Prior to this invention it has been the practice to employ electric initiators to ignite an explosive composition. Electric initiators generally function by heating a bridge wire in contact with a thermally initiable explosive. In an alternate form the bridge wire is replaced by a conductive explosive mix, which consists of a non-electrically conducting explosive powder mixed with a nonexplosive electrically conducting powder. Powdered metals or carbon have been employed for the conductive component of the mixtures while both common primary and secondary explosives have served as the explosive component. Such conductive mixes are placed between electrical terminals or electrodes. Current between the electrodes flows from one conductive particle to another through a series of contact points. Many of such paths form a complex parallel series network but one such path usually has a lower resistance than others so that the current tends to concentrate and the heat tends to concentrate at the contact points. The degree of concentration, and hence the relationship between temperature and electrical input, is dependent on particle size and shape, composition, uniformity of the mixture, loading density and electrode spacing and configuration. For this reason the fabrication of conductive mixes of specified electrical and firing characteristics has been difficult.

SUMMARY OF THE INVENTION

An object of the present invention is to provide an improvement in electric initiators by the use of a material, which overcomes the disadvantages of conductive mixes previously employed in electric initiators.

Another object is to provide an electric initiator wherein the conductive initiator is a single compound, which is an explosive and also has the ability to conduct electrical current.

In accordance with this invention the foregoing and other objects are achieved by utilizing polymeric solid sulfur nitride $(SN)_x$ as the conducting explosive material in an electric initiator.

Polymeric sulfur nitride has been known since 1910, but it is only recently that its structure has been determined and its physical properties more thoroughly investigated. Thus, recent articles disclosing the preparation of polymeric sulfur nitride reveal that the polymer is explosively sensitive to impact and mechanical shear and possesses an electrical conductivity at room temperature on the same order of magnitude as that of a metal, such as mercury (see, for example, Synthesis and Selected Properties of Polymeric Sulfur Nitride, (Polythiazyl), $(SN)_x$, A. G. MacDiarmid et al. Adv. Chem. Ser. 1976,150 (Inorg. Compd. Unusual Prop. Symp., 1975), 63–72, and Synthesis and Structure of Metallic Polymeric Sulfur Nitride, $(SN)_x$, and Its Precursor, Disulfur Dinitride, $S_2N_2$, C. M. Mikulski et al. J. Am. Chem. Soc. 97, 6358 (1975), and Preparation and Characterization of Crystals of the Superconducting Polymer, $(SN)_x$, G. B. Street et al. Materials Research Bull. 10, 877 (1975). However, as far as is known, there is no disclosure of the direct electrical initiation or ignition of polymeric sulfur nitride. Therefore, the discovery according to this invention that polymeric sulfur nitride can be ignited by electrical current is unobvious and provides a unique conductive explosive material for electric initiators and a valuable advance in the art.

BRIEF DESCRIPTION OF THE DRAWING

The drawing shows a schematic diagram of a circuit arrangement of an electric initiator embodying the polymeric sulfur nitride conducting explosive of the present invention.

DETAILED DESCRIPTION OF THE INVENTION

In the embodiment illustrated in the drawing a polymeric sulfur nitride crystal 1, one millimeter wide, one millimeter thick and two millimeters long, was connected at one end 2 to copper lead 3 and at its other end 4 to copper lead 5. The connections were made by contacting the leads to the crystal, applying a silver paint, consisting of a thick dispersion of very fine silver particles in butyl acetate, to the contacts and allowing the paint to dry. The leads 3 and 5 were connected to a variable voltage, high current power supply 6. An ammeter 7 was connected in series and a voltmeter 8 was connected in parallel in the circuit. The resistance measured was 0.2 ohm.

The crystal exploded (deflagrated) completely when a current of 6 amperes and 1.1 volts was applied in the foregoing embodiment.

The crystal of polymeric sulfur nitride $(SN)_x$ employed in the foregoing embodiment was obtained according to the procedure described in the article entitled Synthesis and Structure of Metallic Polymeric Sulfur Nitride $(SN)_x$, and Its Precursor, Disulfur Dinitride, $S_2N_2$, C. M. Mikulski et al. J. Am. Chem. Soc. 97, 6358 (1975).

The foregoing disclosure and drawings are merely illustrative of the principles of this invention and are not to be interpreted in a limiting sense. I wish it to be understood that I do not desire to be limited to the exact details of construction shown and described, because obvious modifications will occur to a person skilled in the art.

What is claimed is:

1. An electric initiator comprising a container, and, located therein, a pair of spaced terminals with an explosive initiating means consisting essentially of polymeric sulfur nitride connected to said terminals.

2. A method of detonating an explosive composition with an electric initiator comprising passing sufficient electric current through a polymeric sulfur nitride crystal whereby said crystal explodes, detonating said explosive composition.

* * * * *